United States Patent [19]

Kamimura

[11] Patent Number: 4,876,573

[45] Date of Patent: Oct. 24, 1989

[54] DEVELOPING METHOD USING NON-MAGNETIC ONE-COMPONENT TONER AND DEVELOPING UNIT THEREFOR

[75] Inventor: Taisuke Kamimura, Nara, Japan

[73] Assignee: Sharp Kabushiki Kaisha, Osaka, Japan

[21] Appl. No.: 311,407

[22] Filed: Feb. 15, 1989

Related U.S. Application Data

[63] Continuation of Ser. No. 74,874, Jul. 17, 1987, abandoned.

[30] Foreign Application Priority Data

Jul. 18, 1986 [JP] Japan ..... 61-170267

[51] Int. Cl.[4] ..... G03G 15/08; G03G 15/06; B05B 5/02; B05C 5/02

[52] U.S. Cl. ..... 355/250; 118/621; 118/650; 355/247; 355/261; 430/120

[58] Field of Search ..... 355/3 DD, 14 D; 118/621, 627, 650, 654, 656–658; 430/120, 122

[56] References Cited

U.S. PATENT DOCUMENTS 4,478,505 10/1984 Tashiro ..... 355/3 DD
4,493,550 1/1985 Takekida ..... 355/14 D
4,557,992 12/1985 Haneda ..... 118/658

FOREIGN PATENT DOCUMENTS 123555 9/1981 Japan ..... 355/14 D
207266 12/1982 Japan ..... 355/3 DD
155144 4/1983 Japan ..... 355/14 D
26759 2/1984 Japan ..... 355/3 DD
26760 2/1984 Japan ..... 355/14 D
195883 5/1984 Japan ..... 355/14 D
179471 8/1986 Japan ..... 355/14 D

*Primary Examiner*—A. T. Grimley
*Assistant Examiner*—Edward J. Pipala
*Attorney, Agent, or Firm*—Birch, Stewart, Kolasch & Birch

[57] ABSTRACT

A developing method using non-magnetic, one-component toner, characterized in that the non-magnetic, one-component toner charged either positively or negatively is retained in cloud-like state in a space facing a photoreceptor drum surface with an electrostatic latent image formed thereon and that an alternating electric field is applied to the zone between the space and the photoreceptor drum surface to cause toner particles to fly about, thus developing the latent image.

10 Claims, 4 Drawing Sheets

DEVELOPING METHOD USING NON-MAGNETIC ONE-COMPONENT TONER AND DEVELOPING UNIT THEREFOR

This application is a continuation of application Ser. No. 074,874 filed on July 17, 1987, now abandoned.

Background of the Invention

The present invention relates to a developing method using a non-magnetic, one-component toner and a developing unit therefor.

Non-magnetic, one-component toner provides the following advantages over two-component toner:

(a) Non-magnetic

Since a magnetic two-component toner requires that the resin constituting the toner must contain iron powder which is difficult to be colored. Consequently, satisfactory color development cannot be expected with the two-component magnetic toner. In contrast, non-magnetic toner is composed of resin alone, with no need for iron powder, so the toner is extremely easy to be colored.

Moreover, the two-component magnetic toner, which iron content in the resin affects the transfer performance, increases the environment dependence of the transfer block. The non-magnetic toner which does not contain iron powder, on the other hand, minimizes environment dependence of the transfer block.

(b) One-component

The one-component toner does not require a carrier, which helps simplify the developing mechanism substantially. As a result, a maintenance-free copying machine of compact design can be realized easily.

Thus, a non-magnetic, one-component toner is obviously advantageous over a two-component magnetic toner.

According to the conventional developing method using a non-magnetic, one-component toner, an image is developed by bringing a photoreceptor into pressure contact with the non-magnetic, one-component toner, (hereinafter referred to simply as toner) charged by friction and retained either electrostatically, mechanically or adhesively on an elastic body, such as a rubber roller or a belt. This method is called touch-down development. This conventional touch-down method based on pressure contact, however, tends to create fogs and causes large amount of toner to scatter. Because of these defects, it has been very difficult from a technical point of view to adopt the touch-down development method the non-magnetic, single component toner in copying machines.

Thus, a successful developing method using non-magnetic, one-component toner has not yet been provided.

SUMMARY OF THE INVENTION

An object of the present invention is to provide a developing method using non-magnetic one-component toner which method retains the toner in a cloud-like state to eliminate the influence by van der Walls' force an the affinity between toner particles, thereby reproducing an electrostatic latent image faithfully.

Another object of the present invention is to provide a developing unit for the above developing method.

Briefly described, in accordance with the present invention, the developing method is characterized in that the non-magnetic one-component toner, charged either positively or negatively, is retained in a cloud-like state in a space facing a photoreceptor drum surface on which an electrostatic latent image is formed and an alternating electric field is applied to zone between the space juxtapositioned the photoreceptor drum surface to cause the toner particles to fly about, thus developing the electrostatic latent image.

The developing unit of the present invention comprises a toner conveyor for transporting non-magnetic, one-component toner while charging the same by friction, a hollow cylinder in which the toner sent through the toner conveyor is stirred to be made into a toner cloud state, the hollow cylinder being located facing the photoreceptor drum with toner passages formed in the area facing the photoreceptor surface, and a screen grid placed between the hollow cylinder and the photoreceptor drum surface and subjected to an alternating electric field.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIGS. 3 through 5 explain an embodiment of the present invention, wherein FIG. 3 is a structural drawing of the developing unit of the present invention, FIG. 4 is a drawing schematically showing the concentration of a copying process block using the developing unit of the present invention, viewed from the front, and FIG. 5 is a diagram showing a developing model of the present invention.

DETAILED DESCRIPTION OF THE INVENTION

Figure 1:
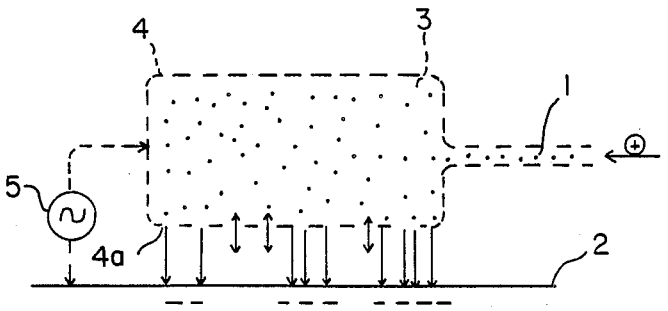
FIG. 1 illustrates the principle of the developing method of the present invention.

FIG. 1 illustrates the principle of the present invention. Non-magnetic, one-component toner 1 may be charged either positively or negatively. In this embodiment, it is assumed that the toner 1 is positively charged and that an electrostatic latent image on a photoreceptor 2 is negatively charged. The positively charged toner 1 is retained in a cloud-like state in a particular space 3 facing the surface of the photoreceptor drum 2. A container 4 of a particular shape is used to define the space 3 so that the toner 1 does not scatter outside the particular space 3. A plurality of toner passages 4*a* are formed in the area of the container 4 facing the photoreceptor drum surface, allowing the toner 1 to pass therethrough. An alternating electric field 5 is applied to the zone between the photoreceptor surface and the toner 1 retained in the space 3.

As the positively charged cloud-like toner 1 retained in the space 3 is subjected to the alternating electric field 5, it provides a flying movement through the toner passages 4*a*. If a part of the photoreceptor drum surface is negatively charged, flying toner particles directed over the negatively charged area are attracted by the negative charge and are attached electrostatically to the photoreceptor drum surface. In this way, the latent image is made visible by the toner 1 retained in the space 3.

Figure 2:
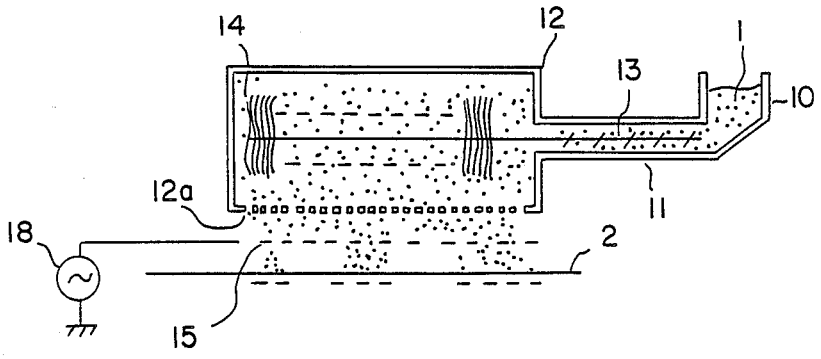
FIG. 2 is a structural drawing of an example of the developing unit of the present invention.

FIG. 2 shows the construction of a developing unit related to the present invention.

The toner 1 in a toner hopper 10 is carried through a toner conveyor 11 to a hollow cylinder 12. A first stirring member 13 is arranged in the toner conveyor 11. The first stirring member 13 charges the toner 1 positively due to the friction between the member 13 and the toner 1. The hollow cylinder 12 contains a second stirring member 14 for further agitating the toner 1, creating cloud-like state. A plurality of toner passages 12*a* are formed in the area of the hollow cylinder 12 facing the photoreceptor surface, permitting the toner 1 to pass therethrough and reach the photoreceptor surface. A screen grid 15 is placed between the photoreceptor surface and the hollow cylinder 12. An alternating voltage 18 is applied to the screen grid 15.

In the developing unit of the above construction, the non-magnetic, one-component toner 1 is agitated to be charged positively by the first stirring member 13 in the toner conveyor 11. The positively charged toner 1 is carried into the hollow cylinder 12 where it is further agitated by the second stirring member 14 to be made into the cloud-like state. The toner cloud 1, freely floating in the cylinder 12, tends to move in the direction of the electrically attracting force. Because of the alternating voltage 18 applied to the screen grid 15, the toner particles pass through the toner passages 12*a*, flying about around the screen grid 15. Of the flying positively charged toner particles, those coming nearest the negative charge on the photoreceptor drum 2 are attracted by the negative charge from the flying movement of the toner, reaching the photoreceptor drum surface and attaching thereto.

An embodiment of the developing method and the developing unit of the present invention in application to an electronic photographic copying machine is hereafter described.

Figure 3:
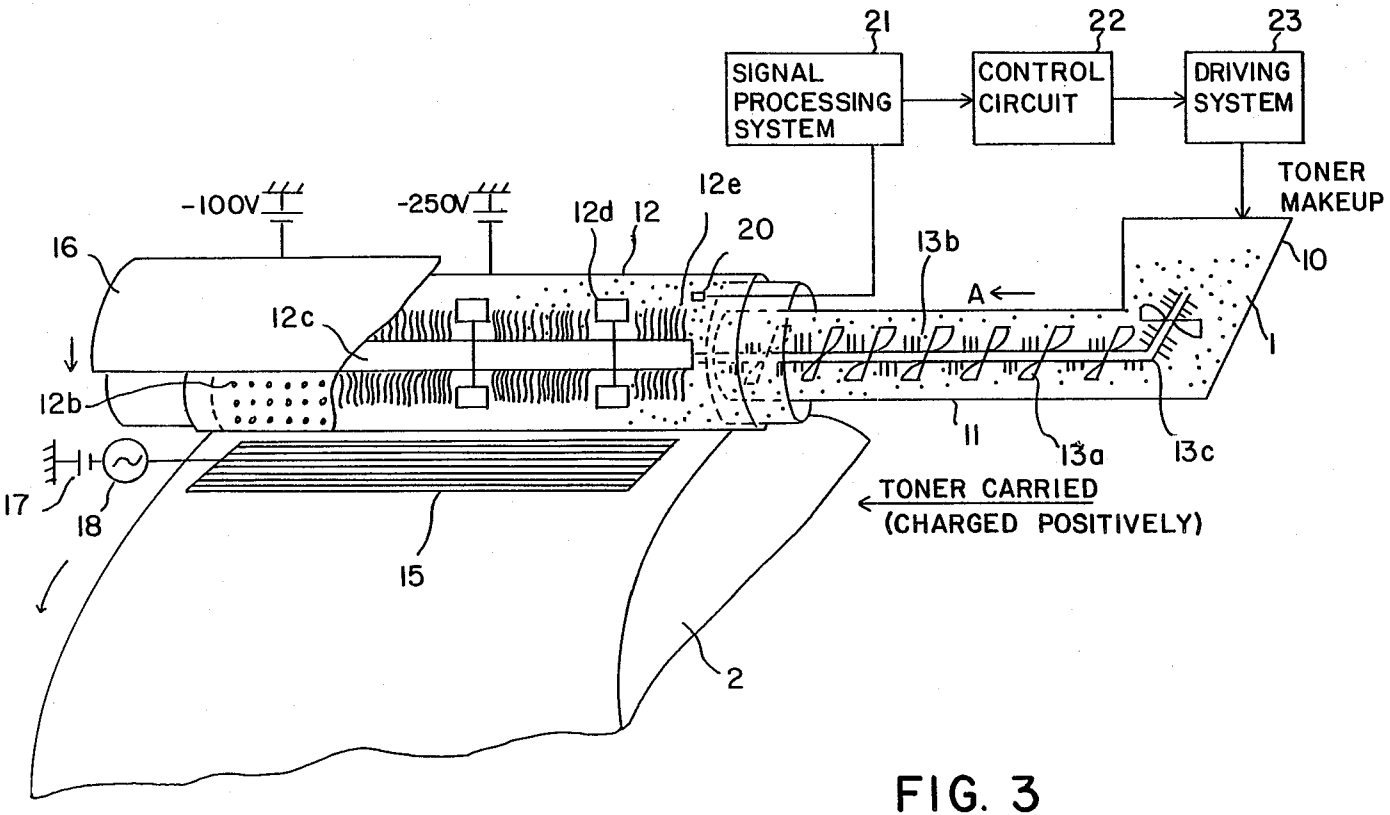
Figure 4:
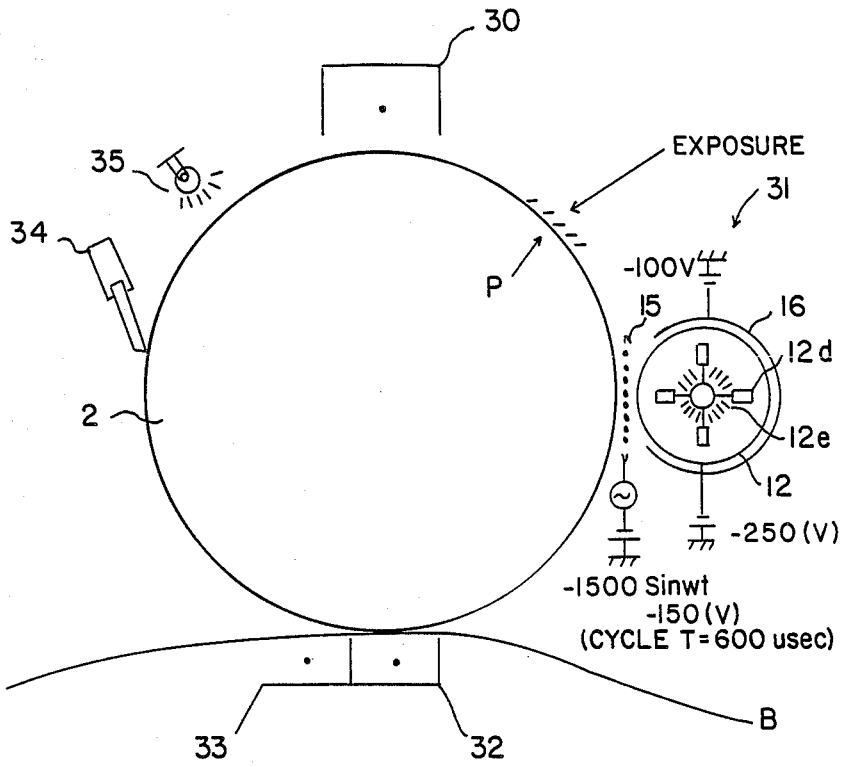

FIG. 3 shows the construction of the developing unit of the present invention, and FIG. 4 is a structural illustration drawing of an electronic photographic processing section including a photoreceptor drum, viewed from the front of the copying machine.

The toner hopper 10 is connected to the toner conveyor 11 in which toner transport plates 13*a* are arranged on the slant on a first rotary shaft 13*c*. The first rotary shaft 13*c* is provided with fur brushes 13*b* between the toner transport plates 13*a*. The toner transport plates 13*a*, the fur brushes 13*b* and the first rotary shaft 13*c* correspond to the first stirring member 13 in FIG. 2. The toner transport plates 13*a* send the toner 1 in the direction indicated by the arrow as they are stirring the toner 1. The fur brushes 13*b* rub the toner 1 to friction charge it positively.

The hollow cylinder 12 of non-magnetic nickel is connected to the other end of the toner conveyor 11 and actuated to be rotating. A plurality of small holes 12*b*, 5 to 20 μm in diameter, are formed in the entire circumference of the hollow cylidner 12, allowing toner particles to pass therethrough. The hollow cylinder 12 contains a second rotary shaft 12*c* coupled to the first rotary shaft 13*c*. The second rotary shaft 12*c* is provided with toner stirring blades 12*d* for mixing toner and with fur brushes 12*e*. The toner carried through the toner conveyor 11 into the hollow cylinder 12 is made cloud-like and charged to saturation by the toner stirring blades 12*d* and the fur brushes 12*e*.

According to the present invention, a developing bias voltage of −250 V is applied to the hollow cylinder 12. The bias voltage has been set to generate smaller static electricity than the one for attracting the toner to the photoreceptor surface as described later. An Al electrode 16 of a semicircular section is mounted to surround the part of the hollow cylinder 12 opposite from the photoreceptor surface. A voltage of −100 V of an opposite polarity from that of the toner 1 is applied to the Al electrode 16.

A screen grid 15 is mounted between the hollow cylinder 12 and the photoreceptor drum 2. An alternating voltage 18 superposed on a dc bias voltage 17 is applied to the screen grid 15. The alternating voltage 18 is set to 1500 V and the dc bias voltage at −150 V.

In the hollow cylinder 12, a toner sensor 20 for detecting the amount of toner in the hollow cylinder 12 is mounted near the outlet of the toner conveyor 11. The toner sensor 20 comprises a micro pressure sensor, which detects the toner quantity in the hollow cylinder by sensing the impact pressure by the toner. The output of the toner sensor 20 is transmitted to a signal processing block 21 and then to a control circuit 22. The control circuit 22 compares the sensor output with a predetermined reference value and controls a toner makeup driving system 23 according to the comparison result, so that the amount of toner in the hollow cylinder 12 is maintained constant. A well-known mechanism may be used for making up toner in the toner hopper 10.

As shown in FIG. 4, a first charger 30, developing unit 31, a transfer unit 32, a separator unit 33, a cleaning blade 34 and a charge-removing lamp 35 are arranged in this order around the photoreceptor drum 2. "P" represents an exposure point. An electrostatic latent image is formed at this point by an optical system (not shown). "B" indicates the course of a copying paper to be supplied.

As mentioned above, a developing bias voltage of −250 V is applied to the hollow cylinder 12, −100 V to the Al electrode 16, and an alternating voltage of $-1500 \sin \omega - 150$ V to the screen grid 15. The picture portion of the latent image of the photoreceptor drum surface is set at −700 V with the background portion set at −100 V.

With the above voltage distribution, the toner 1 is retained in a cloud-like state electrically in the hollow cylinder 12, although the electric attraction by the hollow cylinder 12 is smaller than the attracting force by the static electricity on the photoreceptor drum surface. Meanwhile, the Al electrode 16, to which −100 V of the opposite polarity from the polarity of the charged toner 1 is applied, prevents toner particles 1 from flying out through the small holes 12*b* in the part of the hollow cylinder opposite from the photoreceptor drum surface. Due to the alternating voltage of $-1500 \sin\omega t - 150$ V applied to the screen grid 15, the toner particles fly about in the vicinity of the screen grid 15 through the small holes 12*b*. With this state, when the electrostatic latent image on the photoreceptor drum 2 comes near the flying movement range, the toner particles flying over the picture portion set at −700 V emerge from the flying movement range and attach to the picture portion on the photoreceptor drum surface.

Operation of the developing unit of the present invention is now described further in detail.

The toner 1 supplied in the toner hopper 10 is made of non-magnetic, one-component resin. It is not electrically charged before it is put in the hopper 10. When the toner 1 is supplied in the toner hopper 10, it is carried in the direction of the arrow as being stirred by the toner transport plates 13*a*. Meanwhile it is contacted by the fur brushes 13*b* to be charged positively. The toner 1 has been charged considerably when it is carried into the hollow cylinder 12. There, the toner 1 is further agitated by the toner stirring blades 12*d* and by the fur brushes 12*e* until it is charged to saturation. As a result, the saturation-charged toner 1 is maintained stable in the hollow cylinder 12. Simultaneously, the toner 1 is made cloud-like by the rotating toner stirring blades 12*d* and fur brushes 12*e*, so that the toner 1 is floated in the hollow cylinder 12 without settling on the inside wall thereof. As the developing bias voltage of −250 V is applied to the hollow cylinder 12, the toner 1 is electrically retained in the cylinder 12. The rotating fur brushes 12*e* and toner stirring blades 12*d* are always stirring the toner 1 in this closed space, preventing the toner from sticking on the inside wall of the hollow cylinder due to the voltage of −250 V applied to the cylinder 12.

The plurality of small holes 12*b* in the hollow cylinder 12 measure from 5 to 20 μm in size. Heavy toner particles larger than the holes 12*b* cannot pass through the holes and therefore cannot reach the photoreceptor drum surface. As mentioned earlier, the alternating voltage of $-1500 \sin\omega t - 150$ V is applied to the screen grid 15 placed between the hollow cylinder 12 and the photoreceptor drum 2. This causes the cloud of toner particles 1 in the hollow cylinder 12 to fly about around the small holes 12*b* and the screen grid 15. When an electrostatic latent image comes into the position with the screen grid 15, only toner particles flying over the picture portion (set at −700 V) of the latent image emerge from the flying movement and attach to the photoreceptor drum surface. Meanwhile, toner particles flying over the background portion (set at −100 V) cannot emerge out of the flying movement range because the attracting force of the static electricity of the background portion is not sufficiently large. As this process is repeated, toner particles existing from flying movement range stick selectively on the picture portion of the electrostatic latent image.

Figure 5:
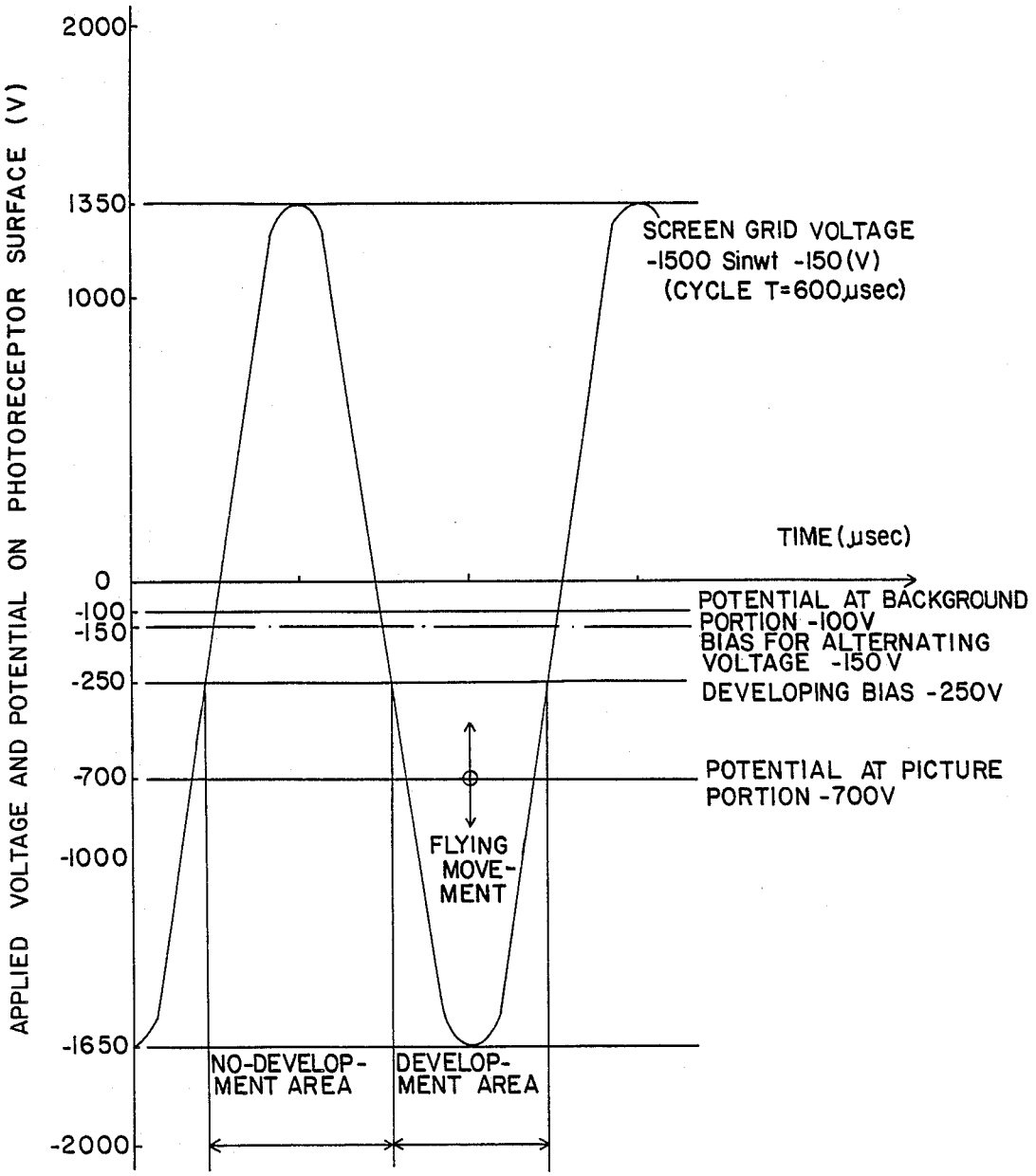

FIG. 5 shows a developing model by the developing unit of the present invention. As shown, the developing bias voltage (−250 V) is between the potential at the background portion (−100 V) and the one between the picture portion (−700 V), ensuring that the toner particles flying about around the screen grid 15 are attracted by the potential at the picture portion, sticking to the picture portion while not being attracted by the potential at the background portion.

The toner sensor 20 installed in the hollow cylinder 12 senses the impact pressure of the toner 1 against the sensor 20 so as to detect the amount of toner in the hollow cylinder 12. The sensor output is sent through the signal processing clock 21 to the control circuit 22, which compares the sensor output with the reference value and accordingly controls the driving system 23 of the toner makeup mechanism, maintaining the amount of toner in the hollow cylinder 12 constant at all times. Thus, with the driving system 23 being actuated automatically according to the toner consumption to charge the toner hopper 10 with controlled amount of toner, the density of the toner cloud is kept constant both in the toner conveyor 11 and in the hollow cylinder 12.

According to this embodiment of the invention, the hollow cylinder 12 has a wall thickness of about 50 μm, and the photoreceptor drum 2 and the hollow cylinder 12 are driven to be rotating in the respective arrow directions.

According to the present invention, since the size of each small hole 12*b* constituting the toner passage is 5 to 20 μm, massive and heavy toner particles larger than the hole 12*b* are not allowed to reach the photoreceptor drum surface. Consequently, the developing unit of the present invention provides faithful reproducibility of an electrostatic latent image and stable development. In addition, since the toner 1 to be used in the present invention is non-magnetic, the resin constituting the toner need not contain iron powder. Such a toner is easy to produce and to color. Besides, the non-magnetic toner without iron powder minimizes the environment dependence of the transfer block.

In the above embodiment, the fur brushes, the toner stirring blades and the toner transport plates are used as the stirring member, although the stirring member may be composed of some other components. The hollow cylinder, which is rotatable in the present embodiment, may be held stationary. In such a case, the small holes 12*b* may be formed only in the area of the hollow cylinder facing to the photoreceptor drum surface, with no need of the Al electrode 16. The bias voltage applied to the hollow cylinder 12 and the alternating voltage 18 superimposed on the dc bias voltage are not essential. They may not be applied as long as toner particles are made to fly about in a satisfactory manner.

According to the present invention, as understood from the above, the toner charged either positively or negatively is retained in cloud-like state in the particular space facing the photoreceptor drum surface. An alternating electric field is applied to the zone between the particular space and the photoreceptor drum surface, so that the toner particles fly about, with only the toner particles near the charged surface of the photoreceptor drum coming out of the flying movement range and contributing to image development.

As a result, the development process of the present invention is stable, reproducing the electrostatic latent image faithfully. Since the cloud of toner particles, freely flying about in the specified range, are selectively attracted electrostatically for developing an image, affinity between toner particles and van de Waals' force generated between the toner and the carrie need not be taken into account. Therefore, it is possible to attain ideal image development depending solely on the electric attraction and free from the influence by the van de Walls' force and the affinity between toner particles.

Since toner is retained within the hollow cylinder, it does not scatter outside the developing unit.

While only certain embodiments of the present invention have been described, it will be apparent to those skilled in the art that various changes and modifications may be made therein without departing from the spirit and scope of the present invention as claimed.

What is claimed is:

1. A developing unit for developing an electrostatic latent image formed on a photoreceptor drum surface with non-magnetic, one-component toner composition comprising in combination:

a conveyor unit for transporting non-magnetic, single component toner particles therein, said conveyor unit including a fur brush means for electrically charging said toner particles by friction;

a photoreceptor drum for forming an electrostatic latent image on the surface thereof having an electrically attracting force;

a hollow cylinder connected with said conveyor unit juxtapositioned to and facing said photoreceptor drum into which said single component toner particles are conveyed, said hollow cylinder including a fur brush means therein for further charging said single component toner particles by friction and for mechanically stirring said toner particles to create a cloud-like state of said toner particles, said hollow cylinder comprising a surface portion having toner passages formed in at least that portion of said surface portion facing said photoreceptor drum surface;

means for applying a bias voltage to said hollow cylinder to assist said fur brush means in stirring said toner particles and creating said cloud-like state of said toner particles, a screen grid mounted in a zone between said hollow cylinder and said photoreceptor drum through which said charged toner particles must pass in the development of said electrostatic latent image; and means for applying an AC bias voltage to said screen grid to cause said toner particles to fly about after emerging from said hollow cylinder to be selectively deposited on said electrostatic latent image.

2. The developing unit of claim 1, wherein said toner passages comprise a plurality of small holes ranging from 5–20 μm in diameter, sized so as to permit said toner particles to pass through.

3. The developing unit of claim 1, wherein said AC bias voltage applied to said hollow cylinder is of such a magnitude that it generates on the inside wall of said cylinder a toner attracting force which is smaller than said electrically attracting force of said electrostatic latent image on said photoreceptor drum.

4. The developing unit of claim 1, wherein said hollow cylinder is rotatable and said toner passages are formed in the entire circumferential surface of said cylinder and which unit further includes an electrode of a semi-circular section mounted to surround that portion of said hollow cylinder facing away from said photoreceptor drum.

5. The developing unit of claim 1, wherein said hollow cylinder is fixed and said toner passages are formed only on the surface area of said cylinder facing said photoreceptor drum.

6. The developing unit of claim 1, further including means to apply an AC bias superposed on a DC bias to said screen grid.

7. A method of developing an electrostatic latent image on a photoreceptor drum which comprises:

providing a photoreceptor drum having an electrostatic latent image formed on the surface thereof;

providing non-magnetic, single-component toner particles in a conveyor for transporting said toner particles;

friction charging said toner particles by means of a fur brush while in said conveyor;

introducing said charged toner particles into a hollow cylinder connected to said conveyor, juxtapositioned to a photoreceptor drum, said hollow cylinder being provided with a fur brush means for further friction charging said toner particles and toner passages formed in at least a surface portion of said cylinder facing said photoreceptor drum to permit passage of said toner particles therethrough;

agitating said toner particles within said hollow cylinder both mechanically and electrically, by mechanically stirring by said fur brush and electrically stirring by applying a charge to said cylinder thereby maintaining said particles in a cloud like state;

providing a screen grid to a zone between said hollow cylinder and said photoreceptor drum where said cylinder is in said facing relationship with said photoreceptor drum;

applying an AC bias to said screen grid so as to impart a flying state to said toner particles as said particles emerge from said cylinder through said toner passages into said zone under the effect of an electrostatic field created by said electrostatic latent image; and developing said electrostatic latent image, said charged toner particles being selectively deposited from said flying state of said toner particles on said electrostatic latent image.

8. The developing method of claim 7, wherein said hollow cylinder is maintained stationary during development of said electrostatic latent image, said toner passages having been provided only on the surface area of said cylinder facing said photoreceptor drum.

9. The developing method of claim 7, wherein said hollow cylinder is rotated during development of said electrostatic latent image, said toner passages having been formed over the entire surface area of said cylinder.

10. The developing method of claim 9, wherein an electrode is provided of a semi-circular section, mounted to surround that portion of said hollow cylinder facing away from said photoreceptor drum and a developing bias is applied to said electrode to prevent said toner particles from flying out through said toner passages in that part of the hollow cylinder facing away from said photoreceptor drum.

* * * * *